US008682010B2

(12) United States Patent
Macours

(10) Patent No.: US 8,682,010 B2
(45) Date of Patent: Mar. 25, 2014

(54) AUTOMATIC ENVIRONMENTAL ACOUSTICS IDENTIFICATION

(75) Inventor: Christophe Marc Macours, Hodeige (BE)

(73) Assignee: NXP B.V., Eindhoven (NL)

( * ) Notice: Subject to any disclaimer, the term of this patent is extended or adjusted under 35 U.S.C. 154(b) by 371 days.

(21) Appl. No.: 12/970,905

(22) Filed: Dec. 16, 2010

(65) Prior Publication Data

US 2011/0150248 A1 Jun. 23, 2011

(30) Foreign Application Priority Data

Dec. 17, 2009 (EP) ..... 09179748

(51) Int. Cl.
*H04R 5/02* (2006.01)

(52) U.S. Cl.
USPC ..... 381/310; 381/309; 381/74; 381/63

(58) Field of Classification Search
USPC ..... 381/74, 71.1, 71.6, 71.12, 61, 63, 381/309–310
See application file for complete search history.

(56) References Cited

U.S. PATENT DOCUMENTS

| | | | | |
|---|---|---|---|---|
| 6,741,707 | B2 * | 5/2004 | Ray et al. | 381/71.11 |
| 7,065,219 | B1 * | 6/2006 | Abe et al. | 381/74 |
| 8,081,780 | B2 * | 12/2011 | Goldstein et al. | 381/119 |
| 8,165,312 | B2 | 4/2012 | Clemow | |
| 2003/0026438 | A1 * | 2/2003 | Ray et al. | 381/71.11 |
| 2007/0165879 | A1 | 7/2007 | Deng et al. | |
| 2007/0297617 | A1 | 12/2007 | Cehelnik | |
| 2008/0037801 | A1 | 2/2008 | Alves et al. | |
| 2008/0137875 | A1 * | 6/2008 | Zong et al. | 381/63 |
| 2008/0187163 | A1 * | 8/2008 | Goldstein et al. | 381/380 |
| 2009/0016541 | A1 * | 1/2009 | Goldstein et al. | 381/57 |
| 2009/0046867 | A1 | 2/2009 | Clemow | |
| 2009/0086988 | A1 * | 4/2009 | Ou et al. | 381/71.6 |
| 2010/0266136 | A1 * | 10/2010 | Kelloniemi et al. | 381/71.6 |
| 2010/0329472 | A1 * | 12/2010 | Nakadai et al. | 381/66 |
| 2011/0188665 | A1 * | 8/2011 | Burge et al. | 381/71.6 |

FOREIGN PATENT DOCUMENTS

| | | |
|---|---|---|
| CN | 1809105 | 7/2006 |
| GB | 2 441 835 A | 3/2008 |

OTHER PUBLICATIONS

Harma, A. et al. "Techniques and Applications of Wearable Augmented Reality Audio," Audio Engineering Society 114th Convention, 20 pgs. (Mar. 2003).

Ratnam, R. et al. "Fast Algorithms for Blind Estimation of Reverberation Time," IEEE Signal Processing Letters, vol. 11, No. 6, pp. 537-540 (Jun. 2004).

Extended European Search Report for European Patent Appln. No. 09179748.0 (May 21, 2010).

* cited by examiner

*Primary Examiner* — Disler Paul

(57) ABSTRACT

A headphone system includes sound processor which calculates properties of the environment from signals from an internal microphone and an external microphone. The impulse response of the environment may be calculated from the signals received from the internal and external microphones as the user speaks.

14 Claims, 3 Drawing Sheets

AUTOMATIC ENVIRONMENTAL ACOUSTICS IDENTIFICATION

This application claims the priority under 35 U.S.C. §119 of European patent application no. 09179748.0, filed on Dec. 17, 2009, the contents of which are incorporated by reference herein.

FIELD OF THE INVENTION

The invention relates to a system which extracts a measure of the acoustic response of the environment, and a method of extracting the acoustic response.

BACKGROUND OF THE INVENTION

An auditory display is a human-machine interface to provide information to a user by means of sounds. These are particularly suitable in applications where the user is not permitted or not able to look at a display. An example is a headphone-based navigation system which delivers audible navigation instructions. The instructions can appear to come from the appropriate physical location or direction, for example a commercial may appear to come from a particular shop. Such systems are suitable for assisting blind people.

Headphone systems are well known. In typical systems a pair of loudspeakers are mounted on a band so as to be worn with the loudspeakers adjacent to a user's ears. Closed headphone systems seek to reduce environmental noise by providing a closed enclosure around each user's ear, and are often used in noisy environments or in noise cancellation systems. Open headphone systems have no such enclosure. The term "headphone" is used in this application to include earphone systems where the loudspeakers are closely associated with the user's ears, for example mounted on or in the user's ears.

It has been proposed to use headphones to create virtual or synthesized acoustic environments. In the case where the sounds are virtualized so that listeners perceive them as coming from the real environment, the systems may be referred to as augmented reality audio (ARA) systems.

In systems creating such virtual or synthesized environments, the headphones do not simply reproduce the sound of a sound source, but create a synthesized environment, with for example reverberation, echoes and other features of natural environments. This can cause the user's perception of sound to be externalized, so the user perceives the sound in a natural way and does not perceive the sound to originate from within the user's head. Reverberation in particular is known to play a significant role in the externalization of virtual sound sources played back on headphones. Accurate rendering of the environment is particularly important in ARA systems where the acoustic properties of the real and virtual sources must be very similar.

A development of this concept is provided in Härmä et al, "Techniques and applications of wearable augmented reality audio", presented at the AES 114th convention, Amsterdam, Mar. 22 to 25, 2003. This presents a useful overview of a number of options. In particular, the paper proposes generating an environment corresponding to the environment the user is actually present in. This can increase realism during playback.

However, there remains a need for convenient, practical portable systems that can deliver such an audio environment.

Further, such systems need data regarding the audio environment to be generated. The conventional way to obtain data about room acoustics is to play back a known signal on a loudspeaker and measure the received signal. The room impulse response is given by the deconvolution of the measured signal by the reference signal.

Attempts have been made to estimate the reverberation time from recorded data without generating a sound, but these are not particularly accurate and do not generate additional data such as the room impulse response.

SUMMARY OF THE INVENTION

According to the invention, there is provided a headphone system according to claim 1 and a method according to claim 9.

The inventor has realised that a particular difficulty in providing realistic audio environments is in obtaining the data regarding the audio environment occupied by a user. Headphone systems can be used in a very wide variety of audio environments.

The system according to the invention avoids the need for a loudspeaker driven by a test signals to generate suitable sounds for determining the impulse response of the environment. Instead, the speech of the user is used as the reference signal. The signals from the pair of microphones, one external and one internal, can then be used to calculate the room impulse response.

The calculation may be done using a normalised least mean squares adaptive filter.

The system may have a binaural positioning unit having a sound input for accepting an input sound signal and to drive the loudspeakers with a processed stereo signal, wherein the processed sound signal is derived from the input sound signal and the acoustic response of the environment.

The binaural positioning unit may be arranged to generate the processed sound signal by convolving the input sound system with the room inpulse response.

In embodiments, the input sound signal is a stereo sound signal and the processed sound signal is also a stereo sound signal.

The processing may be carried out by convolving the input sound system with the room inpulse response to calculate the processed sound signal. In this way, the input sound is processed to match the auditory properties of the environment of the user.

A headphone system for a user has a headset with at least one ear unit, a loudspeaker for generating sound, an internal microphone located on the inside of the ear unit for generating an internal sound signal, and an external microphone located on the outside of the ear unit for generating an external sound signal, and at least one reverberation extraction unit connected to the microphones, arranged to extract an acoustic response of an environment of the headphone system from the internal sound signal and the external sound signal recorded as the user speaks.

In such a headphone system the acoustic response of the environment calculated by the reverberation extraction unit can be an environment impulse response calculated using a normalised least mean squares adaptive filter.

Also, in the headphone system, the adaptive filter in the reverberation extraction unit can be arranged to seek $\hat{w}[n]$ so as to minimize $e[n]=\hat{w}[n]*Mic_e[n]-Mic_i[n]$, where $Mic_e$ is the external sound signal recorded with the external microphone, $Mic_i[n]$ is the internal sound signal recorded with the internal microphone, [n] is a time index, and the minimization is carried out in the least square sense, where * denotes a convolution operation.

Further, the adaptive filter in the reverberation extraction unit can be arranged to seek $\hat{w}[n]$ so as to minimize $e[n]=\hat{w}[n]*Mic_e[n]-h_c[n]*Mic_i[n]$, where $Mic_e$ is the external sound signal recorded with the external microphone (14), $Mic_i$ [n] is the internal sound signal recorded with the internal microphone, [n] is a time index, and the minimization is carried out in the least square sense, * denotes a convolution operation and $h_c$[n] is a correction to suppress from a room impulse response effects of a path from a mouth to the internal microphone and effects of positioning of the external microphone.

The headphone system can have a pair of ear units, one for each ear of the user, and a pair of reverberation extraction units, one for each ear unit.

The headphone system can also include a binaural positioning unit having a sound input for accepting an input sound signal and a sound output for outputting a processed stereo signal to drive the loudspeaker, wherein the processed sound signal is derived from the input sound signal and the acoustic response of the environment.

In the headphone system the binaural positioning unit can be arranged to generate the processed sound signal by convolving the input sound signal with an environment impulse response determined by the at least one reverberation extraction unit.

In the headphone system, the input sound signal can be a stereo sound signal and the processed sound signal also can be a stereo sound signal.

A method of acoustical processing includes providing a headset to a user, the headset having at least one ear unit, a loudspeaker for generating sound, an internal microphone for generating an internal sound signal on the inside of the ear unit and an external microphone located on the outside of the ear unit for generating an external sound signal, generating an internal sound signal from the internal microphone and an external sound signal from the external microphone whilst the user is speaking, and extracting an acoustic response of an environment of the headphone system from the internal sound signal and the external sound signal.

In this method, the step of extracting the acoustic response of the environment can include calculating an environment impulse response using a normalised least mean squares adaptive filter.

In the method, the adaptive filter can seek $\hat{w}[n]$ so as to minimize $e[n]=\hat{w}[n]*Mic_e[n]-Mic_i[n]$, where $Mic_e$ is the external sound signal recorded with the external microphone, $Mic_i$ [n] is the internal sound signal recorded with the internal microphone, [n] is a time index, and the minimization is carried out in the least square sense, where * denotes a convolution operation.

In this method, the adaptive filter can seek $\hat{w}[n]$ so as to minimize $e[n]=\hat{w}[n]*Mic_e[n]-h_c[n]*Mic_i[n]$, where $Mic_e$ is the external sound signal recorded with the external microphone, $Mic_i$ [n] is the internal sound signal recorded with the internal microphone, [n] is a time index, and the minimization is carried out in the least square sense, * denotes a convolution operation and $h_c$[n] is a correction to suppress from a room impulse response effects of a path from a mouth to the internal microphone and effects of positioning of the external microphone.

Such a method also can include processing an input stereo signal and the extracted acoustic response to generate a processed sound signal, and driving the loudspeaker using the processed sound signal.

In the method, the step of processing can involve convolving the input sound signal with the room impulse response to calculate the processed sound signal.

In the method, the input sound signal can be a stereo sound signal and the processed sound signal also can be a stereo sound signal.

BRIEF DESCRIPTION OF THE DRAWINGS

For a better understanding of the invention, embodiments of the invention will now be described, purely by way of example, with reference to the accompanying drawings, in which.

DETAILED DESCRIPTION OF EMBODIMENTS

Figure 1:
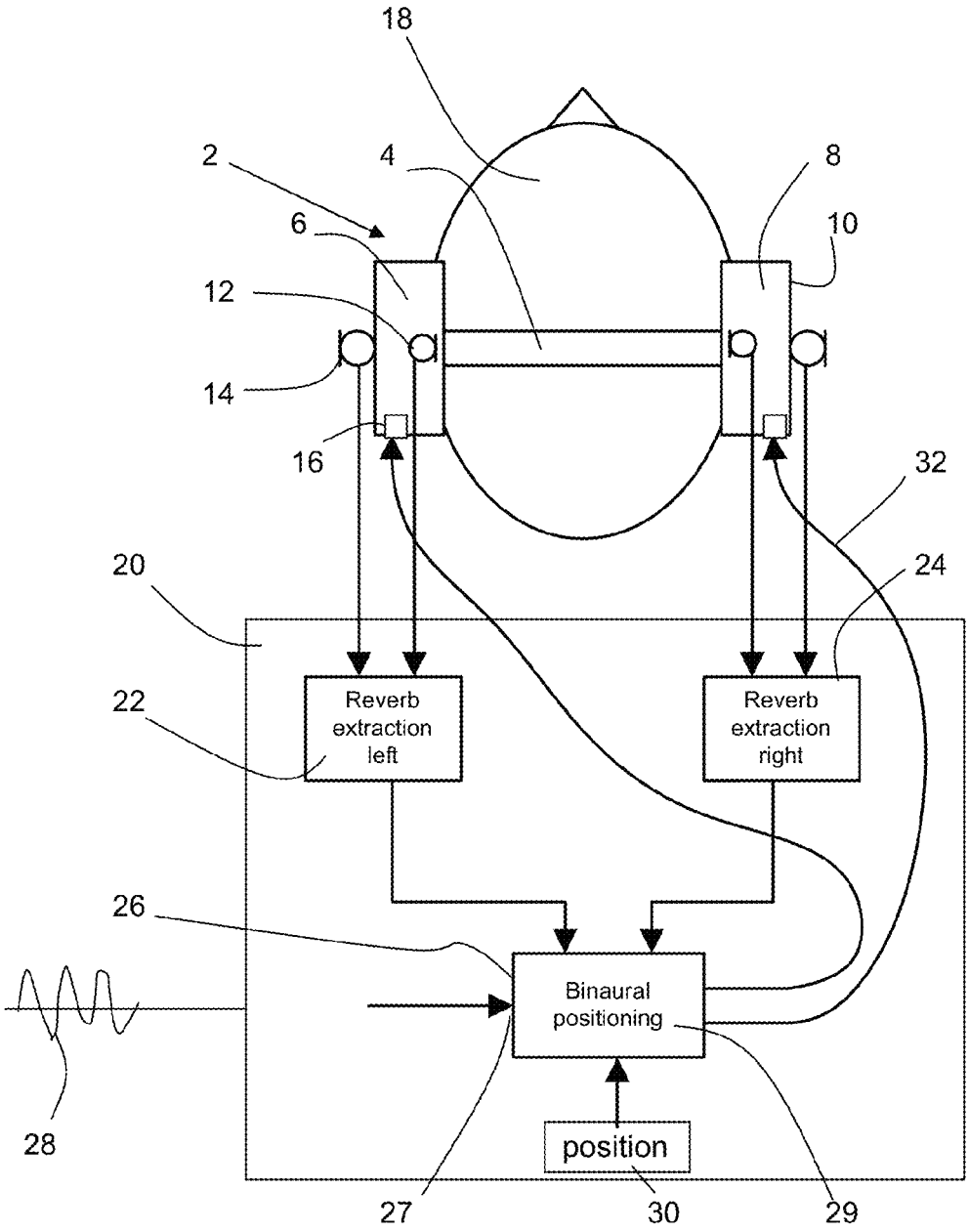
FIG. 1 shows a schematic drawing of an embodiment of the invention.

Referring to FIG. 1, headphone 2 has a central headband 4 linking the left ear unit 6 and the right ear unit 8. Each of the ear units has an enclosure 10 for surrounding the user's ear—accordingly the headphone 2 in this embodiment is a closed headphone. An internal microphone 12 and an external microphone 14 are provided on the inside of the enclosure 10 and the outside respectively. A loudspeaker 16 is also provided to generate sounds.

A sound processor 20 is provided, including reverberation extraction units 22,24 and a binaural positioning unit 26.

Each ear unit 6,8 is connected to a respective reverberation extraction unit 22,24. Each takes signals from both the internal microphone 12 and the external microphone 14 of the respective ear unit, and is arranged to output a measure of the environment response to the binaural positioning unit 26 as will be explained in more detail below.

The binaural positioning unit 26 is arranged to take an input sound signal 28 and information 30 together with the information regarding the environment response from the reverberation extraction units 22,24. Then, the binaural positioning unit creates an output sound signal 32 based on the measures of the environment response to modify the input sound signal and outputs the output sound signal to the loudspeakers 16.

In the particular embodiment described, the reverberation extraction units 22,24 extract the environment impulse response as the measure of the environment response. This requires an input or test signal. In the present case, the user's speech is used as the test signal which avoids the need for a dedicated test signal.

This is done using the microphone inputs using a normalised least mean squared adaptive filter. The signal from the internal microphone 12 is used as the input signal and the signal from the external microphone 14 is used as the desired signal.

The techniques used to calculate the room impulse response will now be described in considerably more detail.

Consider the reference speech signal produced by the user which will be referred to as x. When in a reverberant environment, the speech signal will be filtered by the room impulse response, and reach the external microphone (signal $Mic_e$). Simultaneously, the speech signal is captured by the internal microphone (signal $Mic_i$) through skin and bone conduction. $H_e$ and $H_i$ are the transfer functions between the reference speech signal and the signal recorded with the external and internal microphones respectively. $H_e$ is the desired room impulse response while $H_i$ is the result of the bone and skin conduction from the throat to the ear canal. $H_i$ is typically independent from the environment the user is in. It can be thus measured off-line and used as an optional equalization filter.

Figure 2:
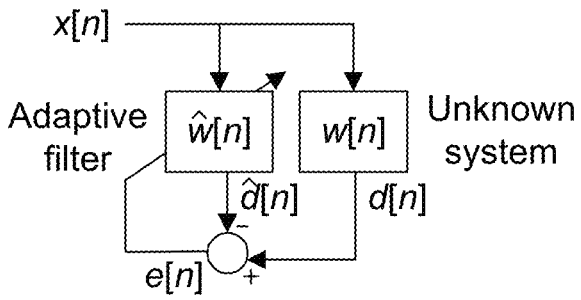
FIG. 2 illustrates an adaptive filter.

One of the many possible techniques to identify the room impulse response $H_e$ based on the microphone inputs $Mic_i$ and $Mic_e$ is an adaptive filter, using a Least Mean Square (LMS) algorithm. FIG. 2 depicts such adaptive filtering scheme. x[n] is the input signal and the adaptive filter attempts to adapt filter $\hat{w}[n]$ to make it as close as possible to the unknown plant w[n], using only x[n], d[n] and e[n] as observable signals.

Figure 3:
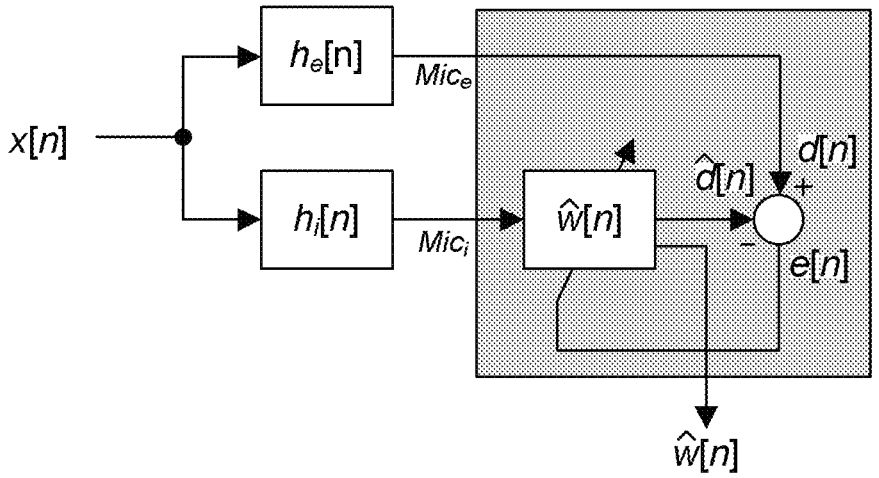
FIG. 3 illustrates an adaptive filter as used in an embodiment of the invention.

In the present invention, illustrated in FIG. 3, the input signal x[n] is filtered through two different paths, $h_e[n]$ and $h_i[n]$, which are the impulse responses of the transfer functions $H_e$ and $H_i$ respectively. The adaptive filter will find $\hat{w}[n]$ so as to minimize $e[n]=\hat{w}[n]*Mic_e[n]-Mic_i[n]$ in the least square sense, where * denotes the convolution operation. The resulting filter $\hat{w}[n]$ is the desired room impulse response between $Mic_i$ and $Mic_e$, and when expressed in the frequency domain to ease notations, we have $$\hat{W}=H_e/H_i.$$

In a further embodiment, the system could be calibrated in an anechoic environment using the same procedure as described above. In this case the resulting filter $\hat{w}_{anechoic}[n]$, expressed in frequency domain is now $$\hat{W}_{anechoic}=H_{e\text{-}anechoic}/H_i \quad (1)$$

$H_i$ is the room independent path to the internal microphone and $H_{e\text{-}anechoic}$, the path from the mouth to the external microphone in anechoic conditions. It includes the filtering effect due to the placement of the microphone behind the mouth instead of in front of it. This effect is neglected in the first embodiment, but can be compensated for when a calibration in anechoic conditions is possible. In the remainder of this document, $H_e$, the path from the mouth to the external microphone, will hence be split in two parts: $H_{e\text{-}anechoic}$ and $H_{e\text{-}room}$, where $H_{e\text{-}room}$ is the desired room response, such that $$H_e=H_{e\text{-}anechoic}\cdot H_{e\text{-}room}. \quad (2)$$

Figure 4:
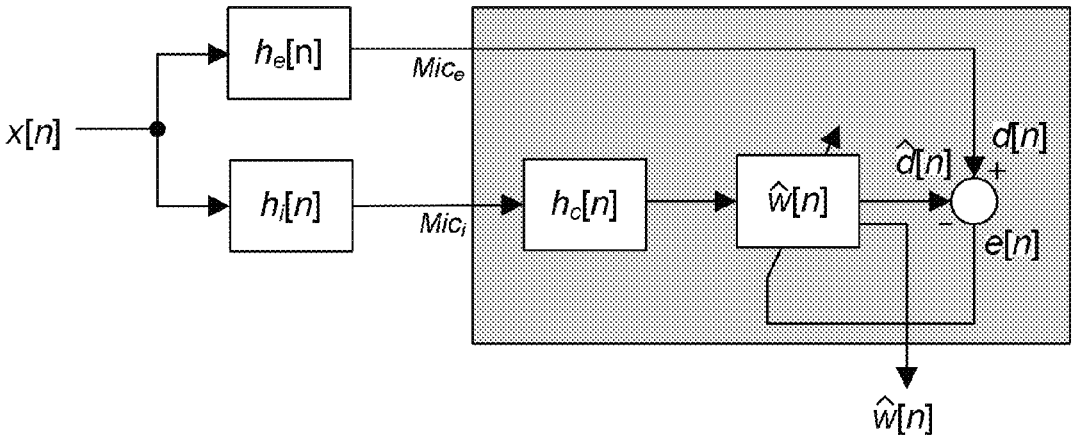
FIG. 4 illustrates an adaptive filter as used in an alternative embodiment of the invention.

$\hat{W}_{anechoic}$ can be used as a correction filter $$H_c=\hat{W}_{anechoic}, \quad (3)$$

illustrated in FIG. 4, to suppress from the room impulse response the path $H_i$ from the mouth to the error microphone and the part of $H_e$ which is due to the positioning of the microphone (i.e. $H_{e\text{-}anechoic}$) and keep only $H_{e\text{-}room}$ as end result.

Indeed, the filter $\hat{w}[n]$ obtained according to FIG. 4 is, in frequency domain, $$\hat{W}=H_e/(H_i\cdot H_c). \quad (4)$$

As seen (1) and (3), we obtain $$\hat{W}=(H_e\cdot H_i)/(H_i\cdot H_{e\text{-}anechoic}). \quad (5)$$

If we split $H_e$ according to (2), we finally obtain $$\hat{W}=H_{e\text{-}room}.$$

Using the anechoic measurement as correction filter indeed allows the suppression of all contributions not related to the room transfer function to be identified.

The environment impulse response is then used to process the input sound signal 28 by performing a direct convolution of the input sound signal with the room impulse response.

The input sound signal 28 is preferably a dry, anechoic sound signal and may in particular be a stereo signal.

As an alternative to convolution, the environment impulse response can be used to identify the properties of the environment and this used to select suitable processing.

When used in a room, the environment impulse response will be a room impulse response. However, the invention is not limited to use in rooms and other environments, for example outside, may also be modelled. For this reason, the term environment impulse response has been used.

Note that those skilled in the art will realise that alternatives to the above approach exist. For example, the environment impulse response is not the only measure of the auditory environment and alternatives, such as reverberation time, may alternatively or additionally be calculated.

The invention is also applicable to other forms of headphones, including earphones, such as intra-concha or in-ear canal earpieces. In this case, the internal microphone may be provided on the inside of the ear unit facing the user's inner ear and the external microphone is on the outside of the ear unit facing the outside.

It should also be noted that the sound processor 20 may be implemented in either hardware or software. However, in view of the complexity and necessary speed of calculation in the reverberation extraction units 22,24, these may in particular be implemented in a digital signal processor (DSP).

Applications include noise cancellation headphones and auditory display apparatus.

The invention claimed is:

1. A headphone system for a user, comprising:

a headset with at least one ear unit, a loudspeaker for generating sound, an internal microphone located on the inside of the ear unit for generating an internal sound signal, and an external microphone located on the outside of the ear unit for generating an external sound signal; and at least one reverberation extraction unit connected to the microphones, arranged to extract an acoustic response of an environment of the headphone system from the internal sound signal and the external sound signal recorded as the user speaks, wherein an adaptive filter in the reverberation extraction unit is arranged to seek [n] so as to minimize $e[n]=[n]*Mic_e[n]-Mic_i[n]$, where $Mic_e$ is the external sound signal recorded with the external microphone, $Mic_i$ [n] is the internal sound signal recorded with the internal microphone, [n] is a time index, and the minimization is carried out in a least square sense, where * denotes a convolution operation.

2. A headphone system according to claim 1 wherein the acoustic response of the environment calculated by the reverberation extraction unit is an environment impulse response calculated using a normalised least mean squares adaptive filter.

3. A headphone system according to claim 2, wherein the adaptive filter in the reverberation extraction unit is arranged to seek $\hat{w}[n]$ so as to minimize $e[n]=\hat{w}[n]*Mic_e[n]-h_c[n]*Mic_i[n]$, where $Mic_e$ is the external sound signal recorded with the external microphone (14), $Mic_i$ [n] is the internal sound signal recorded with the internal microphone, [n] is a time index, and the minimization is carried out in a least square sense, * denotes a convolution operation and $h_c[n]$ is a correction to suppress from a room impulse response effects of a path from a mouth to the internal microphone and effects of positioning of the external microphone.

4. A headphone system according to claim 1 having a pair of ear units, one for each ear of the user, and a pair of reverberation extraction units, one for each ear unit.

5. A headphone system according to claim 4, wherein the input sound signal is a stereo sound signal and the processed sound signal is also a stereo sound signal.

6. A headphone system according to claim 1, further comprising:

a binaural positioning unit having a sound input for accepting an input sound signal and a sound output for outputting a processed stereo signal to drive the loudspeaker, wherein the processed sound signal is derived from the input sound signal and the acoustic response of the environment.

7. A headphone system according to claim 6 wherein the binaural positioning unit is arranged to generate the processed sound signal by convolving the input sound signal with an environment impulse response determined by the at least one reverberation extraction unit.

8. A method of acoustical processing, comprising:

providing a headset to a user, the headset having at least one ear unit, a loudspeaker for generating sound, an internal microphone for generating an internal sound signal on the inside of the ear unit and an external microphone located on the outside of the ear unit for generating an external sound signal;

generating an internal sound signal from the internal microphone and an external sound signal from the external microphone whilst the user is speaking; and extracting an acoustic response of an environment of the headphone system from the internal sound signal and the external sound signal, wherein an adaptive filter seeks [n] so as to minimize $e[n]=[n]*Mic_e[n]-Mic_i[n]$, where $Mic_e$ is the external sound signal recorded with the external microphone, $Mic_i[n]$ is the internal sound signal recorded with the internal microphone, [n] is a time index, and the minimization is carried out in a least square sense, where * denotes a convolution operation.

9. A method according to claim 8 wherein the step of extracting the acoustic response of the environment comprises calculating an environment impulse response using a normalised least mean squares adaptive filter.

10. A method according to claim 8, wherein the adaptive filter seeks $\hat{w}[n]$ so as to minimize $e[n]=\hat{w}[n]*Mic_e[n]-h_c[n]*Mic_i[n]$, where $Mic_e$ is the external sound signal recorded with the external microphone, $Mic_i$ [n] is the internal sound signal recorded with the internal microphone, [n] is a time index, and the minimization is carried out in a least square sense, * denotes a convolution operation and $h_c[n]$ is a correction to suppress from a room impulse response effects of a path from a mouth to the internal microphone and effects of positioning of the external microphone.

11. A method according to claim 8 further comprising:

processing an input stereo signal and the extracted acoustic response to generate a processed sound signal, and driving the loudspeaker using the processed sound signal.

12. A method according to claim 8 wherein the step of processing comprises convolving the input sound signal with the room impulse response to calculate the processed sound signal.

13. A method according to claim 8 wherein the input sound signal is a stereo sound signal and the processed sound signal is also a stereo sound signal.

14. A headphone system for a user, comprising:

a headset with at least one ear unit, a loudspeaker for generating sound, an internal microphone located on the inside of the ear unit for generating an internal sound signal, and an external microphone located on the outside of the ear unit for generating an external sound signal; and a reverberation extraction unit connected to the microphones, wherein an adaptive filter in the reverberation extraction unit is arranged to seek $\hat{w}[n]$ so as to minimize $e[n]=\hat{w}[n]*Mic_e[n]-Mic_i[n]$, where $Mic_e$ is the external sound signal recorded with the external microphone, $Mic_i$ [n] is the internal sound signal recorded with the internal microphone, [n] is a time index, and the minimization is carried out in a least square sense, where * denotes a convolution operation.

* * * * *